United States Patent [19]

Kasher et al.

[11] Patent Number: 4,747,515

[45] Date of Patent: May 31, 1988

[54] APPARATUS FOR MOUNTING ON A LAND VEHICLE FOR THE DISTRIBUTION OF MARKERS

[75] Inventors: Igal Kasher, Kfar Saba; Dan Lupu, Zahala, both of Israel

[73] Assignee: The State of Israel, Ministry of Defence, Israel Military Industries, Israel

[21] Appl. No.: 883,735

[22] Filed: Jul. 9, 1986

[30] Foreign Application Priority Data

Oct. 23, 1985 [IL] Israel ..... 76798

[51] Int. Cl.[4] ..... B65G 59/06

[52] U.S. Cl. ..... 221/116; 221/135; 221/185; 221/297; 221/299; 221/301

[58] Field of Search ..... 221/116, 118, 115, 114, 221/112, 289, 297, 299, 301, 279, 226, 135, 185, 298; 414/129, 128, 126, 125, 115; 116/63 P

[56] References Cited

U.S. PATENT DOCUMENTS

| | | | |
|---|---|---|---|
| 1,162,157 | 11/1915 | Gray | 414/126 |
| 1,270,923 | 7/1918 | Brenzinger | 414/126 |
| 2,613,463 | 10/1952 | Transue | 116/63 P |
| 2,980,288 | 4/1961 | Hunter | 221/116 X |
| 3,478,715 | 11/1969 | Asbury | 116/63 P |
| 3,756,362 | 9/1973 | Pearce | 221/112 X |
| 3,934,539 | 1/1976 | Little et al. | 116/63 P |
| 4,552,089 | 11/1985 | Mahoney | 116/63 P |
| 4,625,893 | 12/1986 | Reiter et al. | 221/297 X |

*Primary Examiner*—Joseph J. Rolla
*Assistant Examiner*—David H. Bollinger
*Attorney, Agent, or Firm*—Steinberg & Raskin

[57] ABSTRACT

An apparatus for dispensing markers for distribution in a terrain. The apparatus is designed as an add-on unit for mounting on the rear of a self-propelled land vehicle.

The markers are units of a foldable type comprising each a base plate and a visible marker member hingedly connected thereto and they are stacked in folded state inside one or more shafts of the apparatus. Near the bottom of each shaft there is provided a delivery gate and shears controllable from the vehicle for the sequential release of individual marker units.

4 Claims, 8 Drawing Sheets

APPARATUS FOR MOUNTING ON A LAND VEHICLE FOR THE DISTRIBUTION OF MARKERS

FIELD OF THE INVENTION

The present invention concerns an apparatus for distribution of markers in a terrain. Markers in a terrain may be required, for example, for the marking of cleared lanes in mine fields, night marking of emergency runways, ground traffic control in and around landing strips, marking of safe routes through difficult terrain, marking of automically, biologically or chemically contaminated areas, and the like.

BACKGROUND OF THE INVENTION AND PRIOR ART

It is known to use markers, e.g. in the form of light sticks, for some of the above-mentioned purposes. To this end the markers are distributed manually which is inconvenient and also dangerous where the marking has to be carried out under hostile conditions and the personnel may thus be exposed to enemy fire, or in a contaminated area where exposure may be fatal. It is accordingly the object of the present invention to provide a mechanical dispenser apparatus for distribution of markers in a terrain, adapted for mounting on the rear of a land vehicle and to be controlled from within the vehicle.

GENERAL DESCRIPTION OF THE INVENTION

In accordance with the present invention there is provided an apparatus for dispensing markers for distribution in a terrain characterized by being designed as an add-on unit for mounting on the rear of a self-propelled land vehicle and further characterized by:

(i) at least one vertical shaft adapted to hold a stack of folded marker units comprising each a base plate and one visible marker member hingedly connected to said base plate so as to be reciprocable between a folded and upright position, means being provided for biasing the marker member into the upright position;

(ii) an opening at the lower end of each shaft (delivery gate) adapted for the delivery of said marker unit;

(iii) means for urging the stack of folder marker units in each shaft towards said delivery gate;

(iv) means associated with each delivery gate for the sequential release of individual marker units comprising two coaxial shears whose end portions are vertically spaced from each other by a distance a defined as $d \leqq a < 2d$ where d is the height of a folded marker unit, said shears being interlocked such that the movement of the shears is phased whereby when one shear converges the other spreads; and (v) controllable drive means linked to one of the shears.

In operation, the delivery gate of each shaft is always blocked by either of the two shears. However, when the upper shear is spread and accordingly the lower is in the converging state, the lowermost marker unit in the shaft drops into the space between the two shears. When now the positions are reversed in that the lower shear is spread while the upper one is caused to converge, the marker unit that had been located between them is released and drops out of the apparatus with concomitant erection of the marker member. At the same time the marker unit next above is prevented from following suit by the converging upper shears. By again reversing the positions of the shears another marker unit drops into the space between them whereby a new cycle is started.

By intermittent repetition of this operation while the land vehicle on which the dispenser is mounted travels, marker units are sequentially dropped at predetermined distances from each other.

The controllable drive means are linked to the inside of the vehicle from where they are controlled by suitable control means, such control means being either automatic whereby the marker units are dropped at a predetermined distance from each other, or being manual whereby the marker units are dropped at will.

Preferably, the control means are shiftable between automatic and manual modes of operation and it is further preferred that in the automatic mode the distance between individually dropped marker units is selectable.

Where the marker element of a marker unit employed in accordance with the invention is of the light stick type which has to be activated by mechanical manipulation, the dispenser apparatus according to the invention will comprise means for the activation of each marker unit before or during its delivery.

In a preferred embodiment of the invention the dispenser apparatus comprises a first and second shaft adapted to hold, respectively, a first and second stack of folded marker units, and said shears are double shears each comprising shear legs extending on both sides of the common axis of the shears to form a first pair of shears associated with the first shaft and a second pair of shears associated with the second shaft. In such an arrangement the deliveries from the shafts are automatically alternating.

The type of land vehicle on which the apparatus according to the invention will be mounted will depend on the required marking performance. Where marking is required in the course of hostile operations the apparatus may be mounted on the rear of a battle tank or an armoured vehicle. Where on the other hand the marking is destined for peaceful operations other vehicles may be used.

An add-on apparatus according to the invention for dispensing marker units may be mounted in the median region of the rear of the vehicle whereby a lane is marked by one median marker row. Alternatively, two dispenser apparatus according to the invention may be mounted on the rear of the vehicle, one on each side, whereby a lane is marked by two fringe rows of marker units.

BRIEF DESCRIPTION OF THE DRAWINGS

For better understanding, the invention will be described hereinafter with reference to the annexed drawings in which:

FIG. 8 is a section along line VIII—VIII of FIG. 6;

FIG. 9 is a section along line IX—IX of FIG. 8; and

DETAILED DESCRIPTION OF A PREFERRED EMBODIMENT

Figure 1:
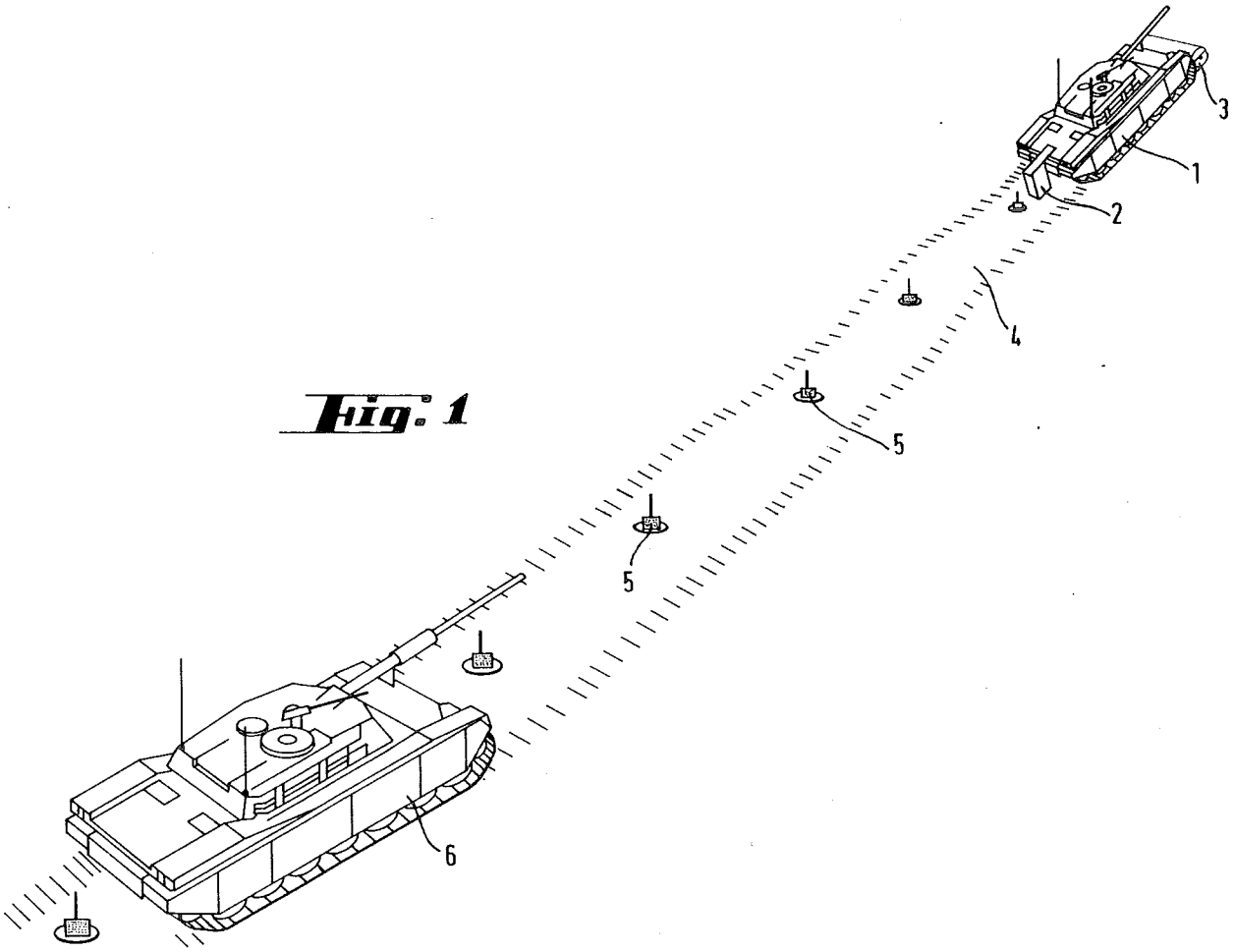
FIG. 1 is a pictorial view showing a first battle tank fitted with an apparatus according to the invention and a second battle tank using the lane marked by the first.

Referring first to FIG. 1, a battle tank 1 having mounted at its rear an add-on apparatus 2 according to the invention and fitted at its front with means 3 for clearing mines, travels through a mine field thereby forming lane 4 free of mines which is marked by a row of marker units 5. Lane 4 is thus free for the passage of other vehicles such as, for example, battle tank 6. The height of each marker unit 5 is such that it remains clear of the centre portion of the following tanks so that their functioning is not impaired.

Figure 3:
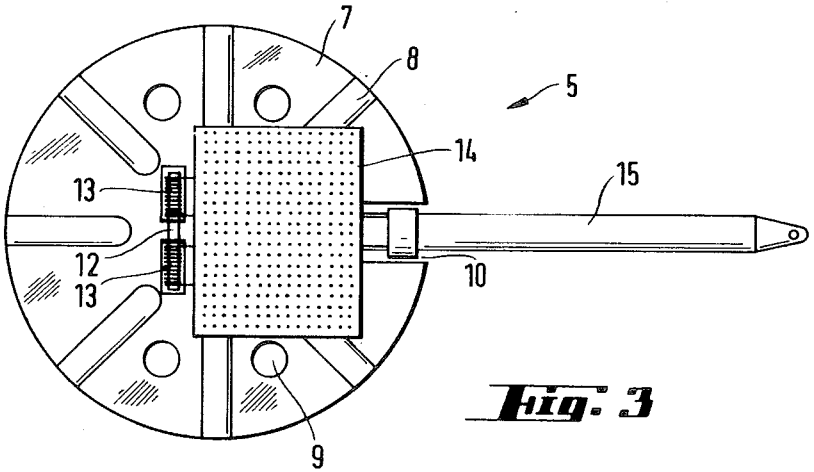
FIG. 3 is a plan view of the marker unit according to FIG. 2 in the folded state.
Figure 2:
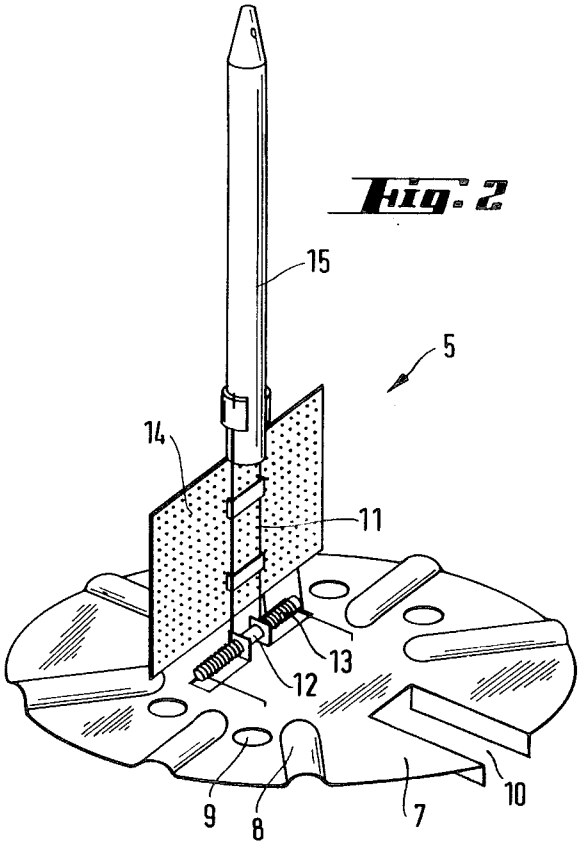
FIG. 2 is a perspective view of a marker unit used in accordance with the present invention and shown in the erected state.

The design of a marker unit 5 as used in accordance with the invention is shown more closely in FIGS. 2 and 3. The marker unit comprises a base plate 7 having a plurality of reinforcing ribs 8, two pairs of holes 9 and a cut-out 10. Holes 9 serve for threading a plurality of units 5 by means of spikes to form a stack which is then charged into an apparatus according to the invention as will be explained further below.

An arm 11 is pivoted at 12 to plate 7 and helical springs 13 bias the arm into the upright position shown in FIG. 2. Mounted on arm 11 are two markers: marker plate 14 which serves for daytime marking and a light stick 15 which serves for nighttime marking. Cut-out 10 serves for receiving the lower portion of light stick 15 in the folded state as shown in FIG. 3.

Figure 4:
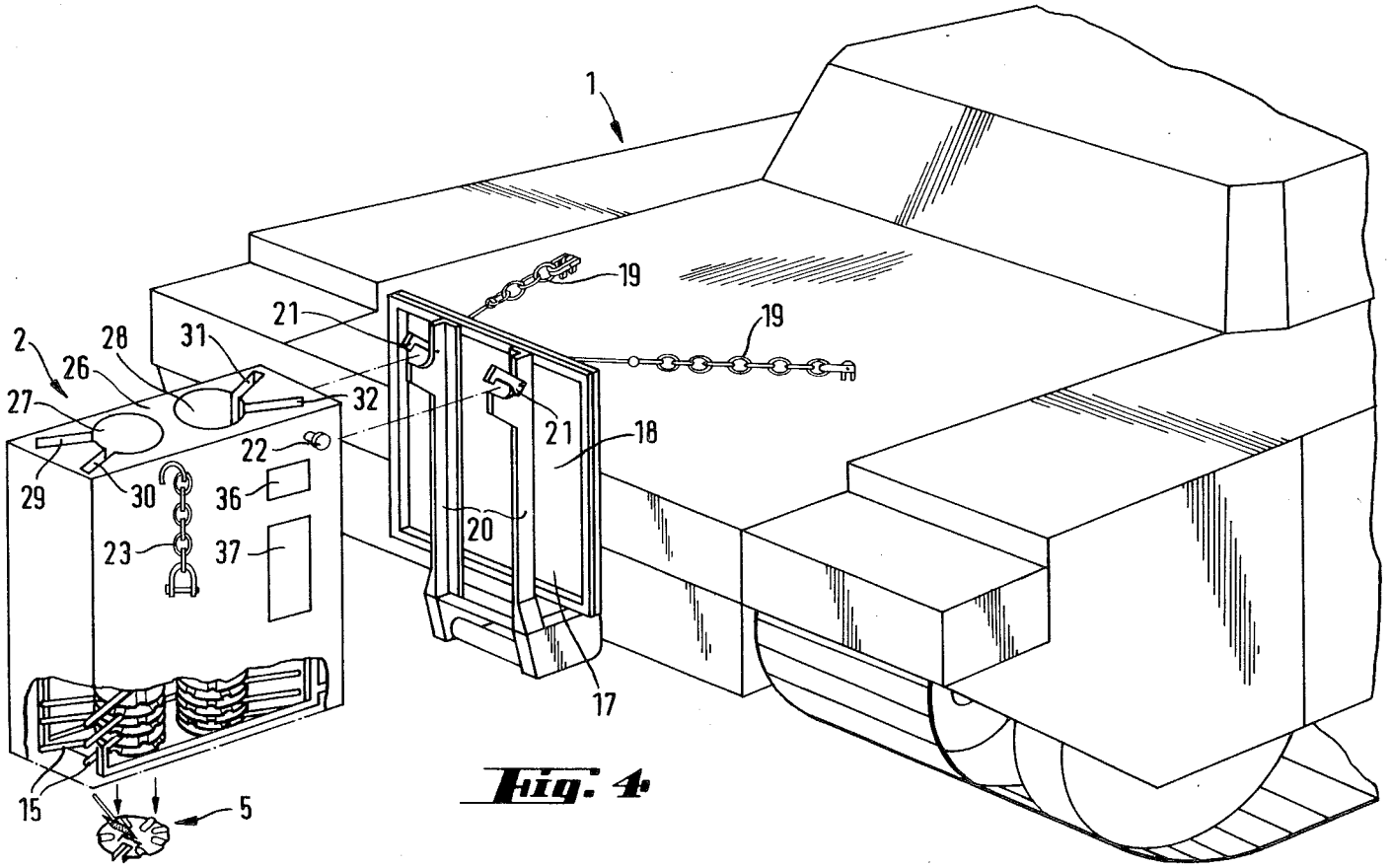
FIG. 4 is an exploded perspective view showing the rear portion of a battle tank fitted with an adaptor and apparatus according to the invention.

Referring now to FIG. 4, there is shown the manner in which an add-on apparatus 2 according to the invention is mounted on the rear of a battle tank 1 (see also FIG. 1). As shown, the rear of the battle tank 1 is fitted with an adaptor 17 comprising a plate 18 attached to the rear of tank 1, among other by chains 19, and comprising ribs 20 fitted with bearings 21.

The apparatus 2 comprises two pivots 22 which are received by bearings 21 of adapter 17 and in this way the apparatus has a freedom of swinging in response to a bumpy terrain. Chains 23 serve as additional fastening means.

Figure 5:
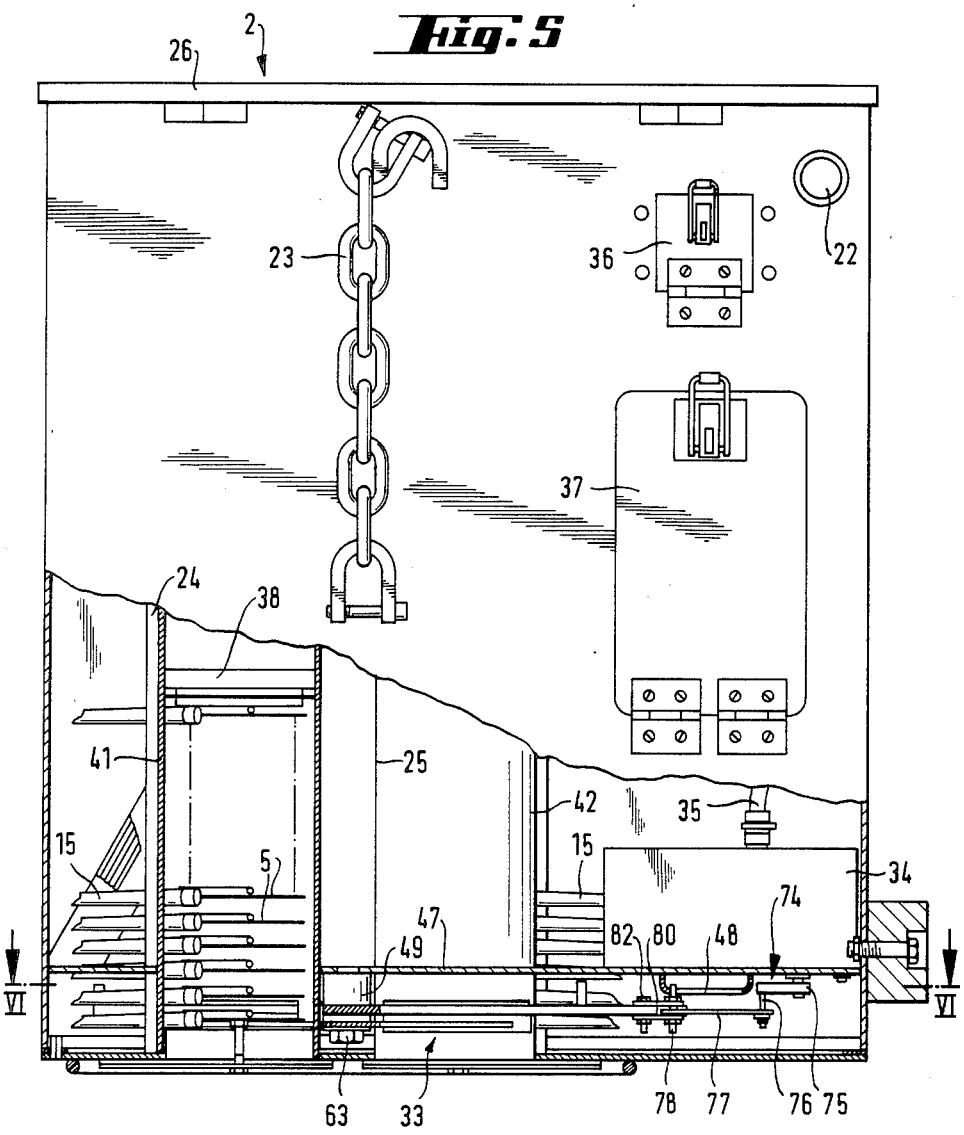
FIG. 5 is a side elevation, drawn to a larger scale, of the apparatus shown in FIG. 4.

As shown in FIG. 5 the apparatus 2 according to the invention here illustrated comprises two vertical shafts 24 and 25 adapted each to hold a plurality of stacked folded marker units 5. Preferably, the marker units in each stack are staggered so that each unit 5 of a stack is angularly displaced with respect to the two flanking units which latter are in turn overlapping. In this way each stack is sub-divided into two groups staggered relative to each other, a first one comprising all even units and a second one comprising all uneven units with units in each group being overlapping and the two groups being angularly displaced towards each other as shown in FIGS. 4 and 5. This arrangement is merely a matter of convenience which enables to maximize the number of marker units that can be accommodated in one single shaft.

By referring to FIG. 4 it is seen that the upper wall 26 of apparatus 2 comprises openings 27 and 28 associated with shafts 24 and 25, respectively. Hole 27 is associated with radially extending cut-outs 29 and 30 and similarly hole 28 is associated with radially extending cut-outs 31 and 32, which cut-outs serve to admit the folded over light sticks 15 of the stacked marker units 5, the angle between each pair of cut-outs 29, 30 and 31, 32 corresponding to the angular displacement between the two groups in each stack.

For loading the marker units 5 into the shafts 24 and 25 the units are first stacked outside the apparatus by threading them on suitably designed pikes (not shown) which engage the holes 9 and each ready formed stack is then introduced into one of the shafts whereupon the pikes are withdrawn.

The apparatus 2 comprises a release mechanism 33 whose design will be explained below with reference to FIGS. 6–9 and, associated therewith, an electric driving motor 34 connected by means of a cord 35 to a socked located behind a lid 36 which socket is electrically connectible to control means located inside the driver's cabin.

A further lid 37 serves as closure for a compartment which serves for storing the electric harness of the apparatus when the latter is not mounted.

Finally, as shown in FIG. 5, each shaft, when loaded holds a weight such as 38 which rests on the uppermost marker unit 5 of the stack and urges the unit towards the delivery gate.

The release mechanism 33 for the marker units will now be described with reference to FIGS. 6–9. As shown, the apparatus 2 comprises a bottom piece 40 having two downward projecting sleeves 41 and 42 which are of the same diameter as and aligned with, respectively, shafts 24 and 25. Sleeves 41 and 42 serve as delivery gates. Sleeve 41 is fitted with two vertical slots 43 and likewise sleeve 42 is fitted with two vertical slots 44, slots 43 and 44 serving for the penetration of the projecting, folded light sticks 15 of marker units 5 (see also FIG. 5). Sleeves 41 and 42 further comprise horizontal slots 45 and 46 respectively, which serve for the penetration of the shears as will be described below.

Depending from the top plate 47 of bottom unit 40 is a slotted bracket 48 serving as guide for a slider-crank mechanism. Also depending from plate 47 and located between sleeves 41 and 42 is a stud 49 which serves for mounting a pivot-and-hub assembly of the shears.

The release mechanism further comprises an upper double shear 51 and a lower double shear 52. The upper double shear 51 comprises two shear legs 53 and 54 having, respectively, lugs 55 and 56, which lugs comprise holes and serve for pivoting. Similarly the lower double shear 52 comprises shear legs 57 and 58 fitted, respectively, with lugs 59 and 60, which lugs also have holes and serve for pivoting. In FIG. 8 the distance between the end portions of the upper legs 53, 54 and the lower legs 57, 58 is indicated at a (only legs 53 and 57 being shown in FIG. 8).

The manner in which the two double shears 51 and 52 are jointly pivoted is shown in FIGS. 8 and 9. As shown, a sleeve 62 countersunk in stud 49 is held in position by means of a screw 63 whose threaded portion 64 engages a correspondingly threaded portion of the bore of stud 49, a washer 65 being interposed between the head of screw 63 and sleeve 62.

As further shown, the hole in lug 56 of shear leg 54 is of a size to fit directly on sleeve 62. Against this the hole in lug 55 of shear leg 53 is of a larger size and fits into a circumferential, annular cut-out in the hub portion of lug 56 of shear leg 54. Likewise, the hole in lug 59 of shear leg 57 fits directly on sleeve 62 while lug 60 of shear leg 58 fits into a circumferential, annular cut-out of the hub portion of lug 59 of shear leg 57. The shears are interlocked by means of protuberances 61 and 61*a* integral with the hub portions of lugs 55 and 56 of the upper double shear 51 and received by correspondingly shaped recesses in the hub portions of lugs 59 and 60 of the lower double shear 52. Due to this interlock, when one shear portion of a double shear is converging the associated shear portion of the other double shear is spread and vice versa.

The release mechanism further comprises a bottom plate 66 and a gasket 67. Bottom plate 66 comprises holes 68 and 71 and associated therewith branch-off cutouts 69, 70 and 72, 73, respectively. Holes 68 and 71 are matching in size with shafts 24 and 25 and the associated sleeves 41 and 42 and are in alignment therewith. Cut-outs 69, 70 and 72, 73 are designed to accommodate the folded-over light sticks 15, the angle between each two cutouts of a pair corresponding to the angular displacement between the two groups of marker units in a stack. In this way, once a marker unit is released it can drop freely through holes 68 or 71, as the case may be, and reach the ground as shown in FIG. 4.

The release mechanism is driven by the electric motor 34 (see FIG. 5) via a slider-crank type transmission comprising a crank 74 having a horizontal arm 75 and a vertical pin 76, an intermediary link 77 and lateral links 79 and 80. Link 79 is pivoted at 81 to shear leg 53 and link 80 is pivoted at 82 to shear leg 54. Furthermore, links 79 and 80 are pivoted to each other by means of a pin 78 engaging the slot of bracket 48.

During each revolution of motor 34 the intermediary link 77 moves back and forth by a distance equal to twice the length of arm 75 of crank 74 and in doing so the intermediary link 77 is moved back and forth being at the same time tilted upwards and downwards while, however, pin 76 merely moves back and forth in the slot of bracket 48, all as known per se. In moving, link 77 pulls and pushes, as the case may be, shear legs 53 and 54 and in consequence they open and close periodically. When the righthand side of the upper, double shear 51 spreads the lefthand side converges and vice versa, when the righthand side converges the lefthand side spreads. Due to the interlock between the upper double shear 51 and the lower double shear 52, movement of the former entrains movement of the latter in such a way that when the righthand side of the upper double shear 51 spreads, the righthand side of the lower double shear 52 converges and when the lefthand side of the upper double shear 51 converges the lefthand side of the lower double shear spreads.

The control of motor 34 is such that a rest period will follow each half revolution (180°) so that each cycle (360°) will comprise two rest periods. The duration of such rest periods can be automatically correlated to the ground speed of the vehicle or be manually controlled.

Near their lefthand side, shear legs 53 and 54 of the upper double shear 51 comprise a pair of jaws 83 and 84 and near the opposite end of shear legs 53 and 54 there are provided jaws 85 and 86.

During their shearing movements the shear legs 53 and 54 of the upper double shear 51 and 57, 58 of the lower double shear 52 penetrate into sleeves 41 and 42 via the horizontal slots 45 and 46.

The marker unit dispensing apparatus according to the invention operates as follows:

As battle tank 1 drives ahead motor 34, manually or automatically controlled from within the tank cabin, rotates intermittently with a rest period after each 180° half revolution. In consequence the shears 51 and 52 perform phased intermitting shearing movements as specified. Starting with the position shown in FIG. 6 and looking first at sleeve 41 associated with shaft 24, it is seen that the upper marker 15*a* is retained by the blocking action of shear legs 53 and 54 while the underlying marker unit visible by its light stick 15*b* only and located underneath the upper shear 51 is free to drop out of sleeve 41 due to the spreading of shear legs 57 and 58 of the lower double shear 52. In consequence of the convergence of shear legs 53 and 54 jaws 83 and 84 bend the light sticks 15*a* and 15*b* as shown in FIG. 6, whereby the light sticks are activated so that when the corresponding marker unit is dropped out of the apparatus the light stick is shining.

Figure 6:
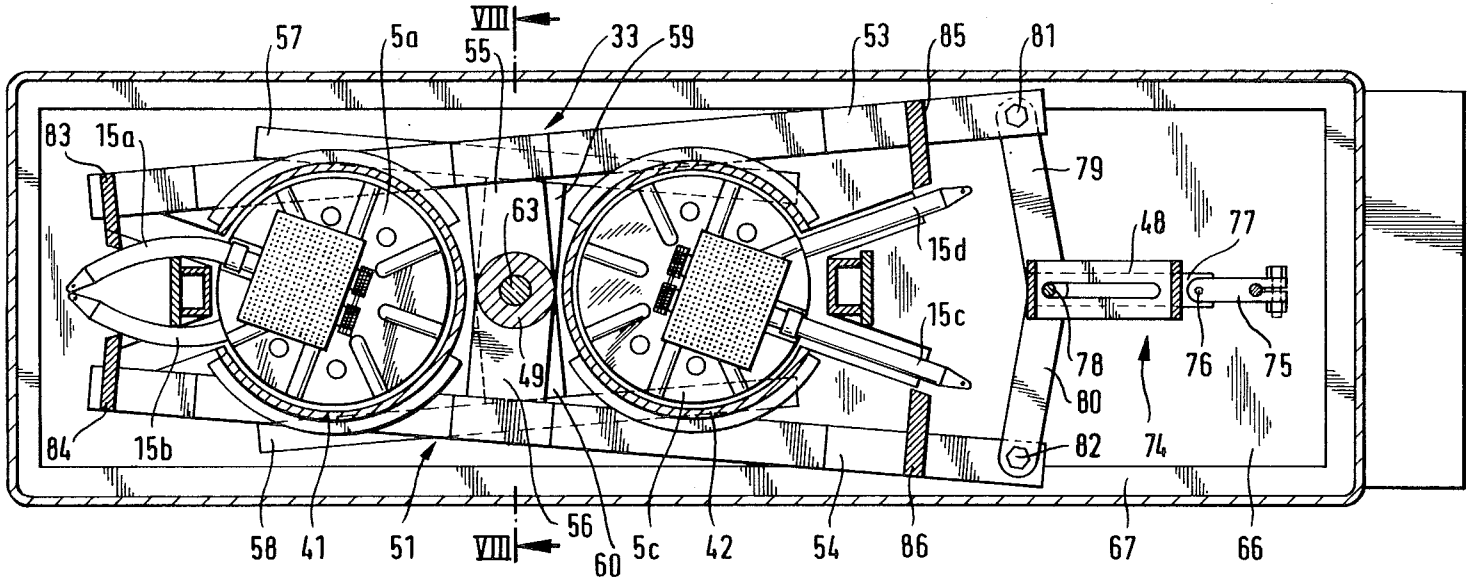
FIG. 6 is a section along lines VI—VI of FIG. 5 drawn to a larger scale and showing the release mechanism.
Figure 7:
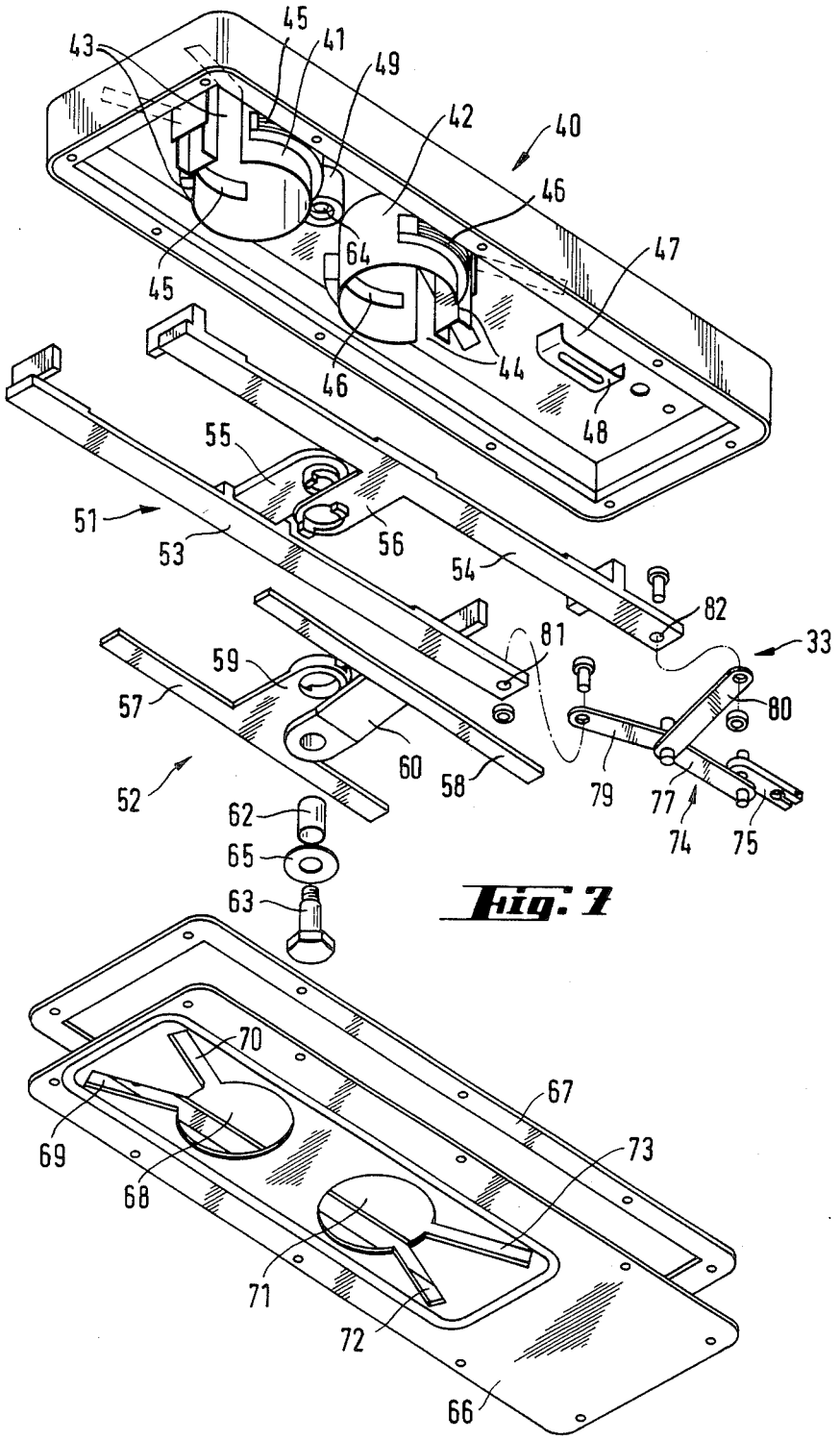
FIG. 7 is an upside-down exploded view of the release mechanism shown in FIG. 6.
Figure 4:
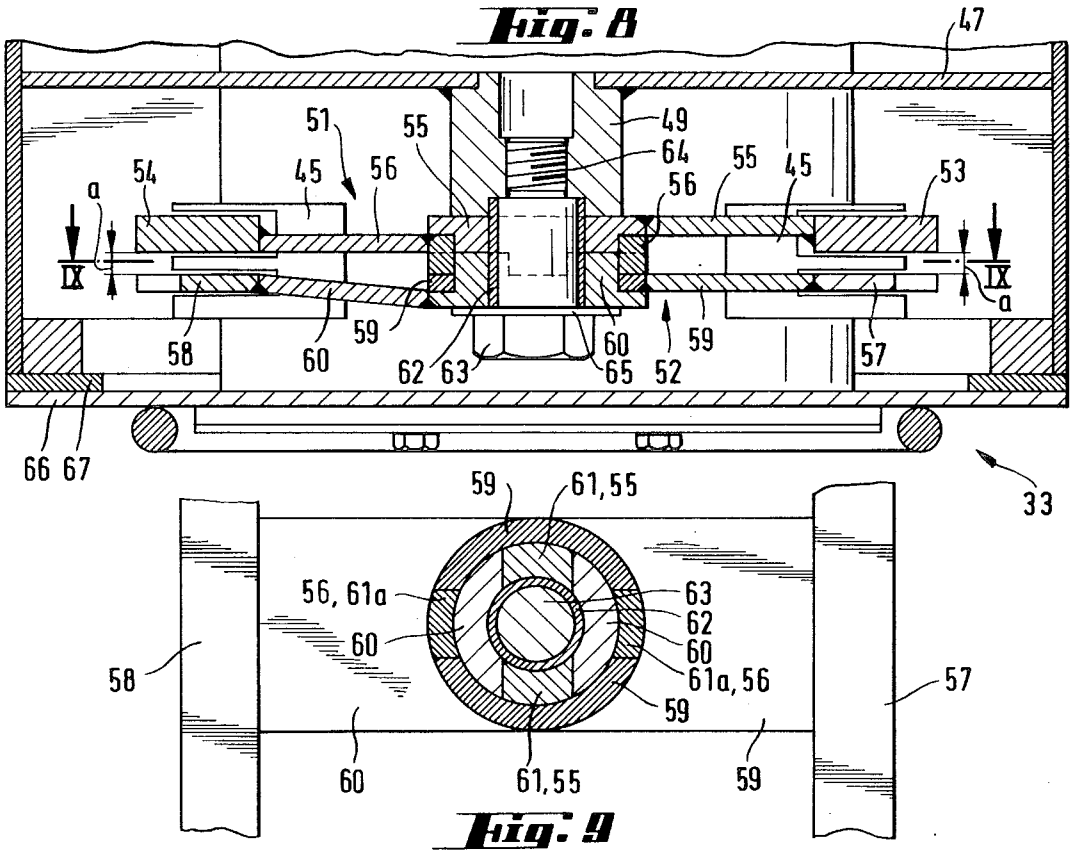

Looking now at sleeve 42 associated with shaft 25, it is seen that in FIG. 6 the lowermost marker unit visible by its light stick 15*d* is retained by the blocking action of shear legs 57, 58 while the upper marker unit 5*c* which would be free to pass between the spread shear legs 53 and 54 is retained by the underlying marker unit visible by its light stick 15*d*.

When now the positions of the shears are reversed in a phased manner so that the lefthand side portions of shear legs 53 and 54 spread while the lefthand side portions of shear legs 57, 58 converge and at the same time the righthand side portions of shear legs 53 and 54 converge while the righthand side portions of shear legs 57, 58 spread, the light sticks 15*c* and 15*d* are activated by the actions of jaws 85 and 86 similarly as shown with respect to sticks 15*a* and 15*b*. At the same time the upper marker unit is blocked and retained in position by the converging shear legs 53 and 54 while the lower marker unit seen only by its light stick 15*d* is free to pass between the spread shear legs 57, 58 and drops on the ground.

It is thus seen how marker units are dropped out alternatingly and at controlled intervals from shaft 24 and 25 via sleeves 41 and 42 respectively, and in this way marker units 5 are strewn along the travel path of tank 1 as shown in FIG. 1.

As soon as a marker unit is released and drops out from the bottom of the apparatus 2, arm 11 with the markers 14, 15 thereon is automatically erected. The bottom plate 7 ensures that the markers always drop with the bottom down and the light stick up.

Figure 10:
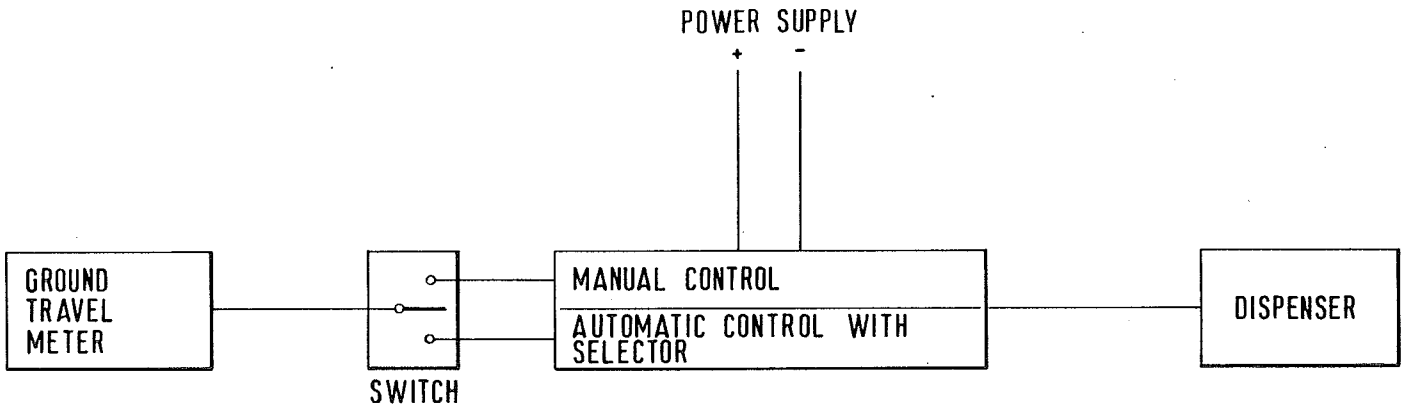
FIG. 10 is a block diagram of an apparatus according to the invention with its controls.

The electric wiring for energizing apparatus 2 is shown diagrammatically in block diagram of FIG. 10. As shown, there is provided a control device which can be switched between automatic and manual control and which is energized by a power supply within the tank. For automatic control, there is provided a ground travel meter whose readings are fed into the automatic control portion where they are adequately processed. The automatic control portion comprises a selector by means of which the distance at which the individual markers are to be dropped is selected. The motor in the dispenser is energized by electric pulses originating from the control and the duration of the rest period between one half revolution and another of the motor is determined by the control device.

Instead of attaching one single dispenser apparatus according to the invention to the rear of a vehicle it is also possible to attach two such apparatuses one on each side so that the lane determined by tank 1 is marked on both edges rather than in the centre thereof.

Instead of linking motor 34 to the upper double shear 51 it may also be linked to the lower one 52.

We claim:

1. In apparatus for dispensing markers for distribution in a terrain being designed as an add-on unit for mounting on the rear of a self-propelled land vehicle, the improvement comprising:

(i) at least one vertical shaft adapted to hold a stack of foldable marker units in folded positions, each marker unit including a base plate, one visible activatable marker member hingedly connected to said base plate so as to be reciprocable between said folded and an upright position, and means for biasing the marker member into the upright position, and wherein said marker member of each marker unit is actuated by bending the same;

(ii) a delivery gate at the lower end of said at least one shaft adapted for the delivery of said marker units;

(iii) means associated with said at least one shaft for biasing a stack of marker units in folded positions in said at least one shaft towards said delivery gate thereof;

(iv) means associated with said delivery gate of said at least one shaft for sequentially releasing individual marker units comprising upper and lower shears having a common axis whose end portions are vertically spaced from each other by a distance a defined as $d<a<2d$ where d is the height of a folded marker unit, said shears being interlocked such that the movement of the shears is phased whereby when one shear converges the other spreads;

(v) controllable drive means linked to one of the shears for driving the shears; and means associated with said lower shear for bending said marker member of a said marker unit when said marker unit is retained between said upper and lower shears, whereby said marker member is activated prior to being ejected from said delivery gate.

2. An apparatus according to claim 1 comprising first and second vertical shafts adapted to hold, respectively, first and second stacks of folded marker units, and wherein said shears are double shears each comprising shear legs extending on both sides of the common axis of the shears to form a first pair of shears associated with the first shaft and a second pair of shears associated with the second shaft.

3. An apparatus according to claim 1 wherein said controllable drive means are linked to one of said shears by a slider crank mechanism.

4. An apparatus according to claim 1 wherein said at least one shaft is adapted to hold a stack of marker units arranged in two staggered, angularly displaced groups.

* * * * *